US006354128B1

(12) United States Patent
Donini et al.

(10) Patent No.: US 6,354,128 B1
(45) Date of Patent: Mar. 12, 2002

(54) METHOD TO ELIMINATE THE PLAY BETWEEN CHOCKS AND RELATIVE SUPPORT BLOCKS IN FOUR-HIGH ROLLING STANDS AND RELATIVE DEVICE

(75) Inventors: Estore Donini, Vimercate; Giacinto Dal Pan, Cellatica, both of (IT)

(73) Assignee: Danieli & C. Officine Meccaniche SpA, Buttrio (IT)

( * ) Notice: Subject to any disclaimer, the term of this patent is extended or adjusted under 35 U.S.C. 154(b) by 0 days.

(21) Appl. No.: 09/582,326

(22) PCT Filed: Dec. 22, 1998

(86) PCT No.: PCT/IB98/02103

§ 371 Date: Jun. 23, 2000

§ 102(e) Date: Jun. 23, 2000

(87) PCT Pub. No.: WO99/33587

PCT Pub. Date: Jul. 8, 1999

(30) Foreign Application Priority Data

Dec. 24, 1997 (IT) ..... UD97A0242

(51) Int. Cl.[7] ..... B21B 31/00

(52) U.S. Cl. ..... 72/237; 72/10.1; 72/10.4; 72/14.4; 72/245

(58) Field of Search ..... 72/10.1, 10.4, 72/13.4, 14.4, 237, 245, 244, 246

(56) References Cited

U.S. PATENT DOCUMENTS

| | | | | |
|---|---|---|---|---|
| 4,116,028 A | * | 9/1978 | Okamoto et al. | 72/237 |
| 5,768,927 A | * | 6/1998 | Kajiwara et al. | 72/10.1 |
| 6,134,935 A | * | 10/2000 | Minnerop | 72/237 |

FOREIGN PATENT DOCUMENTS

| | | | | |
|---|---|---|---|---|
| EP | 0744227 | 11/1996 | | |
| EP | 0815964 | 1/1998 | | |
| JP | 4803149 | 11/1973 | | |
| JP | 56074310 | 6/1981 | | |
| JP | 56074311 | 6/1981 | | |
| JP | 56074312 | 6/1981 | | |
| JP | 59087914 | 5/1984 | | |
| JP | 60118310 | 6/1985 | | |
| JP | 5-38504 | * 2/1993 | | 72/237 |
| JP | 5-237524 | * 9/1993 | | 72/237 |
| JP | 5-269511 | * 10/1993 | | 72/237 |
| JP | 05293518 | 11/1993 | | |
| JP | 08294713 | 11/1996 | | |

* cited by examiner

*Primary Examiner*—Ed Tolan
(74) *Attorney, Agent, or Firm*—Stevens, Davis, Miller & Mosher, LLP

(57) ABSTRACT

A method to eliminate the play between the chock (13) and the support element (16) in four-high rolling stands (10), the rolling stand (10) comprising working rolls (12) and back-up rolls (11) assembled on respective chocks (13, 14), support blocks (16) to support the chocks (13, 14) and a stationary housing (15), the support blocks (16) to support the chocks (13, 14) and a stationary housing (15), the support blocks (16) being arranged between the uprights of the stationary housing (15) and the relative chocks (13, 14) and supporting means for the crossover lateral displacement of the rolls (11, 12), the stand (10) also comprising transmission means to transmit a thrust (19) acting on the upper chock (13) and contrasting the rolling thrust (20), the method providing to define the value of the inward flection of the uprights of the housing (25) according to the value of the rolling thrust (20), to define the entity of play (21) resulting, with the uprights (15) in this condition of flection, between the chock (13, 14) and relative support block (16) during the crossover movements of the chocks (13, 14), and to displace at least one support block (16) towards the relative chock (13, 14) so as to minimize the play (21) to a desired value at least during the rolling passes. A device to achieve the above method.

18 Claims, 1 Drawing Sheet

METHOD TO ELIMINATE THE PLAY BETWEEN CHOCKS AND RELATIVE SUPPORT BLOCKS IN FOUR-HIGH ROLLING STANDS AND RELATIVE DEVICE

FIELD OF THE INVENTION

This invention concerns a method to eliminate the play between chocks and the relative support blocks in four-high rolling stands, and the relative device, as set forth in the respective main claims.

The invention is employed to minimize and even eliminate the value of the play and gaps between the chocks and the uprights of the housings, or between the chocks and the supporting bearing elements, or gibs, during the cross-over movement of the rolls (pair crossing).

BACKGROUND OF THE INVENTION

The state of the art includes the rolling technique of pair crossing, wherein the working rolls, and possibly the relative back-up rolls, are crossed over so as to obtain a wide field of adjustment of the crown of the rolls, a better control of the profile of the rolled stock during the processing step and therefore a better quality final product.

During the crossover of the rolls, and because of it, a moment of flection is generated on the chocks of the back-up rolls; this moment of flection is determined by the misalignment of the vertical thrust forces which the rolled stock impresses on the rolls with respect to the load exerted by the hydraulic pressure means acting on the chocks of the said back-up rolls.

In other words, according to the angle of crossing of the rolls, the position of the horizontal resultant of the force of the hydraulic pressure means and the force transmitted by the rolled stock to the relative working roll, and from this to the back-up roll, may even be positioned outside the supporting planes between the chocks of the back-up rolls and the relative support blocks-gibs.

When this happens, the chock is no longer correctly supported and a flection torque is generated.

This flection torque generates an increase, on one side, in the forces which are exerted between the support element or gib and the relative chock.

This fact, with the same coefficient of friction between the sliding elements included between the chock and the supporting element, leads to an increase in the forces of friction.

Moreover, this turnover component generated by the flection torque tends to make the chock rotate on the vertical plane with respect to its longitudinal axis and, should there be an excessive gap, or a gap which has not been pre-set, between the chock and the housing, or between the chock and the support block, it can cause the edges of the chock itself to tip up against the relative bearing element.

This unplanned space or play between the chock and the bearing element can be caused by various factors, including the absence of compensation means or an imperfect functioning of such compensation means as are present.

This space or play in any case must always be guaranteed during the design step, even if only at a minimum value, due to the contraction of the space of the housing stressed by the rolling force.

This contraction of the space is due to the deformation under load of the structure of the housing which leads to the deformation of the uprights which bend, to values in the order of one or two millimetres, and curve inwards at the centre because of the extremely high rolling loads, causing zones of maximum proximity of the chock and the relative gib.

This play must therefore be planned in such a way that, when the rolling forces which deform the housing of the stand are at their highest values, there is no jamming of the chocks and the relative gibs. The greater the horizontal contraction of the uprights of the housing is, the greater the play must be.

An incorrect value of the play can lead to a risk of blows and impacts during the crossover displacement of the chock and relative gib or bearing block.

All this leads to incorrect functioning, risks of jams and damage, inaccurate control of the thickness and profile of the rolled stock, and therefore the final products are not of optimum quality and the sliding surfaces between the chocks and the gibs are subject to premature wear.

Moreover, the very presence of play between the chocks of the working rolls and the relative support blocks can lead to an inaccurate control of the angle of crossing of the rolls.

This leads to errors and imperfections in the technological control of the rolling process, with negative consequences on the adjustment of the profile and the thickness of the strip.

Furthermore, the presence of unplanned play can cause vibrations to start, caused by the horizontal movement of the working rolls in the direction of rolling.

The interaction of possible horizontal vibrations of the working rolls with the rolling process itself can generate self-excited linear vibrations, caused by the fact that the coefficient of rolling friction is a function of the relative speed of the rolls and the material being rolled.

Document JP-A-05-293518 describes a method to adjust the crossing angle between the working rolls in a four-high rolling stand according to the rolling load.

It provides to continuously monitor the value of the rolling load by means of a measuring device provided for this purpose, and to send the relative signal to a processor which adjusts in feedback the drive of the hydraulic jacks which act on the chocks of the working rolls.

This document does not teach to minimize the play between the chocks and the relative support blocks as the rolling load varies.

Documents JP-A-56-074310, JP-A-56-074311 and JP-A-56-074312 refer to devices to control on-line the thickness of the strip based on the control of the deformation of the stand under working conditions and with a crossing angle which is not zero.

In practice, these devices provide to calculate the actual deformation of the stand by continuously measuring the actual rolling force and the crossing angle, and taking into account the working parameters such as width and thickness of the strip.

According to these calculations, the pressure means on the stand are consequently adjusted so as to maintain the thickness of the strip at the values established by the working specifications.

The evolution described in JP'311 provides to control the actual position of the chocks, rather than the crossing angle, in such a way as to compensate any difference between the center of the crossing angle of the rolls and the vertical median plane of the stand.

These documents, like JP'518, do not provide to compensate the play between the chock and support blocks according to the rolling load.

Document JP-A-08-294713 shows a method to annul the play between the chocks of the working rolls and the back-up rolls and the relative support blocks in a four-high rolling stand, wherein hydraulic compensation cylinders are provided, on the inlet side of the stand, associated with position transducers.

The position transducers monitor the actual position of the chocks and supply this value to the relative hydraulic cylinders, which are thus able to take the chocks, at the outlet side of the stand, into contact with the relative support blocks.

This solution, although it is efficacious in itself, does not take into account the variation of the rolling load, and is simply directed to compensate wear on the sliding parts, which increases with time.

Document JP-A-59-087914 describes an embodiment which is substantially the same as the previous one.

The present applicants have designed, tested and embodied this invention to overcome this serious disadvantage which businessmen in the field have long complained of, and also to obtain further advantages.

SUMMARY OF THE INVENTION

The invention is set forth and characterized in the respective main claims, while the dependent claims describe other characteristics of the main embodiment.

The purpose of the invention is to provide a play compensation method, and a device connected thereto, suitable to obviate those problems which derive from the partial rotation of the chock of the back-up rolls with respect to the housing, or the support element, due to the turnover component caused by the eccentricity between the rolling thrust and the thrust of the hydraulic pressure system.

In other words, the invention proposes to optimize the value of the lateral play which is created between the chock and the relative support element during the crossing of the rolls, taking into account the entity of the horizontal contraction of the uprights of the housing during the rolling passes, in such a way that the turnover component which is inevitably generated can be at least partly compensated and so that in any case it does not create the aforesaid problems.

Another purpose of the invention is to minimize the vibrations of the working rolls on the horizontal plane during the rolling passes which start themselves off because of the play between the chocks and the support blocks.

A further purpose of the invention is to reduce and even eliminate the play between the chocks and the relative support blocks in order to minimize the technological problems due to inaccuracies in the control of the crossing angle which affect the control of the profile and the thickness of the strip being rolled.

According to the invention, the pressure signal from the load cell which monitors the thrust exerted by the hydraulic pressure means acting on the chock of the back-up roll is monitored and sent continuously to a processing and control unit.

Depending on the hydraulic pressure imparted to exert the rolling load, this signal provides information which makes it possible to define the entity of the theoretical contraction of the space of the housing due to the flection of the uprights, and therefore the entity of the consequent play, during the condition of contraction, between the chock and the relative support element.

Depending on the pressure signal, appropriately processed, the processing and control unit commands the activation of appropriate actuators which act on the support blocks so as to bring them near the relative chocks and at least optimize the lateral play between the chock and the support element to a desired value.

According to a variant, the value of contraction of the space defined by the rolling stand housings is calculated in advance, when the stand is inoperative, according to the expected value of the rolling force.

According to this pre-calculated value and the crossing program of the rolls during the rolling passes, the reference values of the position of the support blocks of the chocks are defined, in such a way that the play between the chocks and the blocks is substantially zero during rolling.

The rolling program can be pre-set or can be a consequence of the rolling conditions which occur on each occasion.

According to a further variant, the position of the support blocks with respect to the relative chocks is adjusted in such a way as to obtain an over-compensation of the play during rolling.

In other words, a support block is compressed, on one side, against the relative chock with a pre-set clamping force in order to be sure that no accidental movements are generated on the horizontal plane of the working and back-up rolls.

The value of the clamping force is defined so that the product of the clamping force and the coefficient of friction between the chocks and the relative support blocks, which supplies the value of the hysteresis of the hydraulic pressure means acting on the chock of the back-up roll, is less than a defined value.

In a preferential embodiment, the maximum threshold value is in the order of 20 tonnes, as the sum of all the vertical friction forces.

According to the invention, the displacement imparted to the support blocks takes place according to continuous values.

According to a variant, this displacement takes place when necessary, every time the contraction of the housing uprights makes the play between chock and support block exceed a maximum threshold, or is below a minimum limit threshold.

According to another variant, in cooperation with the chocks and the relative support blocks there are reciprocal distance monitoring means; these means serve to continuously control the distance between the chock and the relative support block as the rolling thrust varies.

These means supply control and reference data to the system.

The crossover displacement means which achieve this compensation, according to a variant, can be actuators attached to the stationary housing of the rolling stand and act on one side only.

According to a variant, the actuators are arranged symmetrically on opposite sides of the respective chocks.

BRIEF DESCRIPTION OF THE DRAWINGS

The attached Figures are given as a non-restrictive example, and show a preferential embodiment of the invention as follows.

DETAILED DESCRIPTION OF PREFERRED EMBODIMENT

Figure 2:
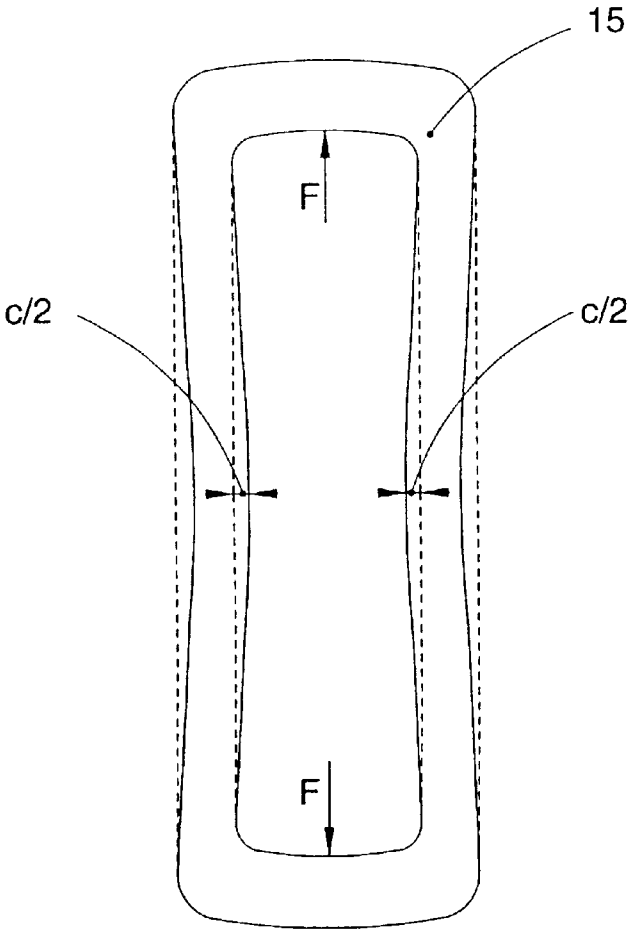
FIG. 2 shows a diagram of the horizontal contraction of the housing of the stand to which the invention is applied.
Figure 1:
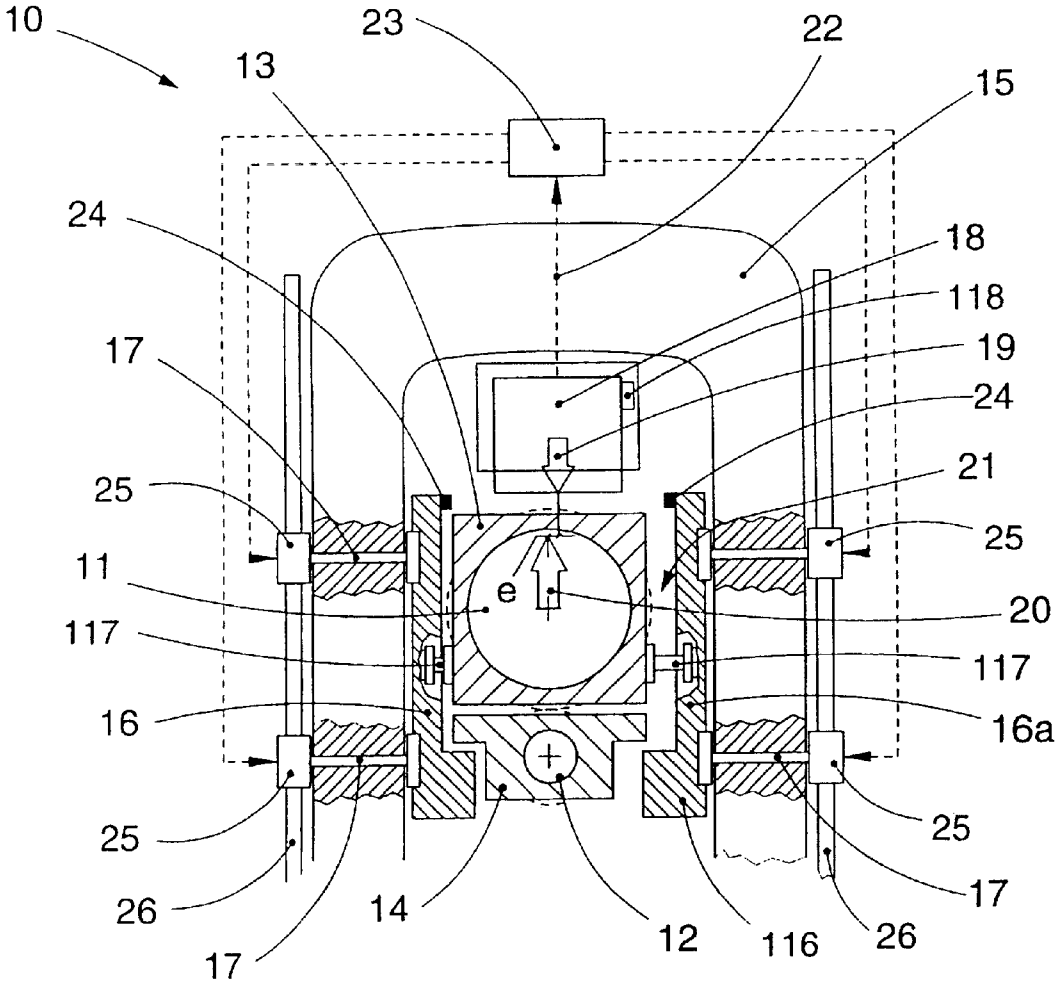
FIG. 1 shows part of a four-high rolling stand adopting the invention.

In the attached drawings the reference number 10 denotes generally the upper part of a four-high rolling stand adopting the invention and comprising back-up rolls 11 and working rolls 12 cooperating with respective supporting chocks 13 and 14.

The rolling stand 10 also comprises a stationary housing 15 on which supporting gibs 16 are supported in such a way that they can slide on a horizontal plane; in this case they are L-shaped.

To be more exact, the gibs 16 include at least lower fins 116 conformed as brackets which function as a supporting and sliding plane for the chocks 14 of the working rolls 12.

Between the fins 116 and the supporting surfaces of the chocks 14, as in the state of the art, there are sliding elements suitable to reduce sliding friction.

It is exactly the same if the supporting gibs 16 are F-shaped, or have any other suitable shape such as is known to the state of the art.

The sliding connection between the supporting gibs 16 and the stationary housing 15 is taken as known, and is therefore not shown in detail.

In this case, there are lateral displacement means provided on the supporting gibs 16; the lateral displacement means consist of actuators 17 which act on the gibs 16 and, in cooperation with analogous actuators, not shown here and associated with the lower gibs, carry out the crossover movement of the upper and lower rolls.

In this case, there are auxiliary compensation actuators, or simply compensation means, 117 which act between the gibs 16 and the relative chocks 13 and 14, which serve to compensate the play and to stabilize the univocal connection between the gibs and the chocks.

The actuators 17 can be driven by means 25 which can be screw means, cam means, or of any other type such as are known in the art, and which include command means 26 of a type such as are known in the art.

The compensation means 117 are preferentially of the type with a hydraulic jack, but they may also be of the screw, cam, or lever type, etc., since as far as the purposes of the invention are concerned their mechanical conformation is irrelevant.

Between the upper crosspiece of the housing 15 and the chock 13 of the upper back-up roll 11 there is a hydraulic cylinder device 18 which exerts a thrust of downwards pressure, denoted generally by the reference number 19, which compensates the upwards thrusts, indicated by the number 20, which are generated by the rolling loads.

The hydraulic cylinder 18 is associated with means to monitor the rolling force, consisting for example of a load cell 118.

In the lower part of the stand 10, which is not shown here, there are conventional shims and systems to adjust the pass-line of the stand, and possibly other systems to read the rolling pressure.

The invention is described only with regard to the upper part of the stand 10, however it is implicit that the application is extended also to the lower part.

Due to the crossover movements of the rolls 11 and 12 during the rolling passes, between the thrust 19 of the hydraulic cylinder 18 and the rolling thrust 20 an eccentricity "e" is generated which causes a turnover component on the chock 13.

If this turnover component is not compensated by a lateral support, it may lead to blockages and damage; moreover, it causes an increase in the friction between the supporting surfaces of the chocks and the relative supporting surfaces in the supporting gibs 16.

This is due to the design and construction plays and to unforeseen gaps, shown by the reference number 21, which are created between the chocks 13–14 and the relative gib 16 both because of the not always perfect functioning of the actuators 17, 117, and also because of the inward flection and bending of the uprights of the housing 15 (see FIG. 2), which requires the play to be provided for in inoperative conditions, and also for other reasons.

According to the invention, the actuators 17 are arranged outside the relative supporting gibs and are suitable to exert thereon a controlled thrust to bring them nearer the relative chock 13 or 14.

The differential existing between the actuators 17 located on one side and those located on the other side of the chocks causes the lateral displacement of the chocks 13 and 14.

The activation of the actuators 17 is regulated, in a first embodiment, according to the signal 22 relating to the pressure exerted by the hydraulic cylinder 18 on the chock 13 of the back-up roll 11 as continuously monitored by the load cell 118.

In other words, when the rolls have been positioned, the signal 22 relating to the pressure exerted by the hydraulic cylinder 18 is continuously monitored and sent to a processing and control unit 23, which processes it, reads the desired information therefrom and on each occasion controls the activation of the actuators 17 to maintain the play existing between the chock 13 and the supporting gibs 16 at an optimum and pre-set value.

If there are compensation means 117 present, the task of maintaining the pre-set value of play is fine-tuned, and within certain values of the said compensation means 117.

To be more exact, the processing and control unit 23, according to the signal 22 relating to the pressure exerted on the chocks, calculates the theoretical value of the total contraction corresponding to the said pressure value; the contraction is indicated by "c" in FIG. 2 and broken down into its two components, left and right, with a value of "c/2", of the uprights of the housing 15.

Once having defined the desired optimum play to be ensured between the chock 13 and the relative gib 16, and having established the theoretical position of the gib 16 according to the value of inward contraction of the uprights of the housing 15, the processing and control unit 23 commands the controlled activation of the actuators 17.

The invention therefore allows to minimize, and even annul, the play between the chocks and the support elements in every step of the rolling process and without requiring position transducers or other complex control mechanisms.

According to a variant of the afore-said method, the theoretical value of the contraction of the housings 15 is calculated in advance, before the process is started, according to the expected values of the rolling force to be applied.

Then, according to the pre-determined program of crossing over the rolls, a table is established for the positioning of the supporting gibs 16 so that the desired value of play 21 is always obtained during the rolling process.

The processing and control unit 23, in this case, is associated with the actuators 17 acting on both sides of the gibs 16.

During the crossover movement of the rolls, the chocks 13, 14 approach the relative supporting gib 16 until they substantially rest thereon, while they move away from the other gib 16 positioned on the opposite side, defining with the said gib 16 a play indicated by the reference number 21.

In a first embodiment of the invention, the play 21 is taken to an optimum value by activating only the actuators 17 arranged on the side where the chock is farther from the relative gib 16.

According to a variant, the actuators 17 arranged on both sides of the chock 13 are activated until the desired optimum value of play 21 is obtained.

The actuators 17 are driven as a function of the signal arriving from the hydraulic cylinder 18 until the play 21 existing between the chock 13 and the relative gib 16, in this case the gib 16*a,* is taken to an optimum value.

According to a variant, a displacement movement is imparted to the supporting gib 16a such as to generate on the opposite gib 16 a clamping value against the relative chock 13 of a desired value, so that no accidental movements of the rolls 11 and 12 are generated during the rolling pass.

In the embodiment shown here, in cooperation with the gibs 16 there are distance sensors 24, as a further refinement of the process, which continually monitor the distance or gap between the chock 13 and the relative gib 16 and send the signal monitored to the processing and control unit 23 so that it can intervene and achieve the best possible operating conditions.

In another embodiment, the compensation means 117 intervene within certain minimum values of the play 21.

According to a variant, the compensation means 117 intervene continuously for a fine compensation of the play.

What is claimed is:

1. A method to eliminate play between a chock and support block in a four-high rolling stand, the rolling stand comprising working rolls on respective first chocks, back-up rolls on respective second chocks, support blocks (16) to support the first chocks and the second chocks, a stationary housing having uprights, the support blocks being arranged between the uprights of the stationary housing and the relative chocks, supporting means for lateral crossover displacement of the working rolls and back-up rolls including an actuator acting on at least one member of the group consisting of at least one of the first chocks and at least one of the second chocks, and a transmission means including a hydraulic cylinder to transmit a thrust acting on at least one second chock on a longitudinal median plane of the stand and against a rolling thrust, the method comprising the steps of:

defining a value of inward deflection of the uprights of the housing according to a respective value of the rolling thrust, defining an amount of play between the chock and relative support block, the play resulting from the value of the inward deflection of the uprights of the housing during crossover movements of the first chocks and the second chocks, and displacing at least one support block towards the relative chock to minimize the play to a desired value at least during rolling passes.

2. The method as in claim 1, wherein:

a load sensor continuously defines, during the rolling passes, the value of the rolling thrust, the deflection of the uprights of the housing is defined according to the rolling thrust continuously monitored, and an amount of displacement to be imparted to the support block towards the respective chock is defined to obtain a desired value of play between the respective chock and the support element.

3. The method as in claim 1, wherein the value of the inward deflection of the uprights of the housing is defined when the stand is in an inoperative condition, according to an expected value of the rolling thrust, and the position of the support blocks with respect to the relative chocks is set during rolling passes according to the crossover positioning of the first chocks and the second chocks.

4. The method as in claim 1, wherein the play resulting between the respective chock and the relative support block is defined according to the value of the rolling thrust, and the displacing step includes moving at least one support block towards the relative chock by a value greater than the play so as to obtain a desired clamping pressure between the chock and the relative support block.

5. The method as in claim 1, wherein the values of the play and the displacement of the support blocks are calculated by a processing and control unit.

6. The method as in claim 1, wherein the values of the play and the displacement of the support blocks are obtained by monitoring the values by distance sensors.

7. The method according to claim 1, wherein the displacing step occurs during rolling passes.

8. The method according to claim 1, wherein an auxiliary compensation actuator adjusts distance between at least one said support block and at least one said chock.

9. The method according to claim 1, wherein the transmission means transmits said thrust on the second chocks of at least one said back-up roll on the longitudinal median plane of the stand in a direction opposite the rolling thrust.

10. The method according to claim 1, wherein the support block is a gib.

11. A device to eliminate play between a chock and a support block in a four-high rolling stand, the rolling stand comprising working rolls on respective first chocks, back-up rolls on respective second chocks, support blocks to support the chocks, a stationary housing having uprights, the support blocks being arranged between the uprights of the stationary housing and the relative chocks, supporting means for lateral crossover displacement of the working rolls and backup rolls, the supporting means including an actuator acting on at least one member of the group consisting of at least one of the first chocks and at least one of the second chocks, transmission means including a hydraulic cylinder to transmit a thrust acting on at least one second chock on a longitudinal median plane of the stand opposing a rolling thrust, the device comprising:

a processing and control unit configured to define a theoretical value of inward deflection of the uprights of the housing according to a value of the rolling thrust and to define an amount of play resulting from the inward deflection, with the uprights in this condition of deflection, between each chock and relative support block during crossover movements of the first chocks and the second chocks, and a displacement means, governed by the processing and control unit, which act on a relative said support block to displace the support block towards the relative chock during rolling passes to minimize the play to a desired value.

12. The device as in claim 11, further comprising a monitoring means in communication with the transmission means to transmit thrust and configured to continuously monitor a signal relating to the rolling thrust so as to send the signal to the processing and control unit.

13. The device as in claim 11, further comprising a monitoring means for monitoring the play between at least one said chock and the relative support block and to send a signal relating to the play between at least one said chock and the relative support block to the processing and control unit.

14. The device according to claim 11, wherein the transmission means includes a hydraulic cylinder.

15. The device according to claim 11, wherein an auxiliary compensation actuator is provided between at least one said support block and at least one said chock.

16. The device according to claim 11, wherein the transmission means is for transmitting said thrust on the second chocks of at least one said backup roll on the longitudinal median plane of the stand in a direction opposite the rolling thrust.

17. The device according to claim 11, wherein the support block is a gib.

18. A device to eliminate play between a chock and a support block in a four-high rolling stand, comprising:

the rolling stand comprising working rolls on respective first chocks, back-up rolls on respective second chocks, support blocks to support the chocks, a stationary housing having uprights, the support blocks being arranged between the uprights of the stationary housing and the relative chocks, supporting means for lateral crossover displacement of the working rolls and backup rolls, the supporting means including an actuator acting on at lease one member of the group consisting of at least one of the first chocks and at least one of the second chocks, transmission means including a hydraulic cylinder to transmit a thrust acting on at least one second chock on a longitudinal median plane of the stand opposing a rolling thrust, a processing and control unit configured to define a theoretical value of inward deflection of the uprights of the housing according to a value of the rolling thrust and to define an amount of play resulting from the inward deflection, with the uprights in this condition of deflection, between each chock and relative support block during crossover movements of the first chocks and the second chocks, and a displacement means, governed by the processing and control unit, which act on a relative support block to displace the support block towards the relative chock during rolling passes to minimize the play to a desired value.

* * * * *